US009598271B2

(12) United States Patent
Kritzer

(10) Patent No.: US 9,598,271 B2
(45) Date of Patent: Mar. 21, 2017

(54) PORTABLE AUTOMOBILE LIFT

(71) Applicant: BendPak, Inc., Santa Paula, CA (US)

(72) Inventor: Jeffrey S. Kritzer, Moorpark, CA (US)

(73) Assignee: BENDPAK, INC., Santa Paula, CA (US)

( * ) Notice: Subject to any disclaimer, the term of this patent is extended or adjusted under 35 U.S.C. 154(b) by 39 days.

(21) Appl. No.: 14/487,813

(22) Filed: Sep. 16, 2014

(65) Prior Publication Data

US 2015/0076431 A1 Mar. 19, 2015

Related U.S. Application Data

(63) Continuation-in-part of application No. 29/467,149, filed on Sep. 16, 2013, now Pat. No. Des. 716,514, and a continuation-in-part of application No. 29/498,920, filed on Aug. 8, 2014, now Pat. No. Des. 748,361.

(60) Provisional application No. 62/032,312, filed on Aug. 1, 2014.

(51) Int. Cl.
*B66F 7/10* (2006.01)
*B66F 5/04* (2006.01)

(52) U.S. Cl.
CPC ..... *B66F 5/04* (2013.01)

(58) Field of Classification Search
USPC ..... 254/89 H, 90, 133 R, 122, 124, 126
See application file for complete search history.

(56) References Cited

U.S. PATENT DOCUMENTS 4,848,732 A * 7/1989 Rossato ..... B66F 7/08 187/208
4,921,074 A * 5/1990 Ochs ..... B66F 7/26 187/204
5,050,844 A * 9/1991 Hawk ..... B66F 7/0633 254/89 H
D344,835 S 3/1994 MacEachern
(Continued)

OTHER PUBLICATIONS

Advertising materials of BendPak, Inc. showing LR-60 and LR-60P low rise automobile lifts, believed to have been on sale for more than one year prior to the filing date of the present application.
(Continued)

*Primary Examiner* — Joseph J Hail
*Assistant Examiner* — Shantese McDonald
(74) *Attorney, Agent, or Firm* — Erickson Kernell IP, LLC

(57) ABSTRACT

A jack assembly includes a base, a support platform, a pair of links connecting the base to the support platform and an actuator connected between the base and the support platform. The actuator is operable to move the support platform between lowered and raised positions. The actuator may be coupled to a power assist cylinder which utilizes pressurized compressible fluid to assist in lowering the support platform. A safety lock system includes a lock bar pivotally connected to the support platform and one or more pockets on the base positioned to receive a free end of the lock bar to retain the support platform in a selected raised position. A preferred support platform includes trays which receive contact blocks selected from a set of varied contact blocks. A portable automobile lift comprises a pair of the jack assemblies in combination with a portable power unit.

19 Claims, 10 Drawing Sheets

(56) References Cited

U.S. PATENT DOCUMENTS

| | | | | |
|---|---|---|---|---|
| D346,255 | S | 4/1994 | Francis et al. | |
| D375,602 | S | 11/1996 | Henthorn et al. | |
| D378,155 | S | 2/1997 | Bartow et al. | |
| 6,059,263 | A | 5/2000 | Otema et al. | |
| 7,021,861 | B2 * | 4/2006 | Basta | B63C 3/00 114/44 |
| D596,823 | S | 7/2009 | Thurm | |
| 8,256,577 | B2 | 9/2012 | Kritzer | |
| D703,906 | S | 4/2014 | Gann et al. | |
| 2010/0207085 | A1 | 8/2010 | Thurm | |
| 2011/0278517 | A1 * | 11/2011 | Deuring | B66F 7/08 254/122 |
| 2014/0014886 | A1 | 1/2014 | Ruth sen. | |

OTHER PUBLICATIONS

Advertising materials of BendPak, Inc. showing P-6B and P-6FB low rise automobile pit lifts, believed to have been on sale for more than one year prior to the filing date of the present application.
Advertising materials of BendPak, Inc. showing the RML-600XL motorcycle and ATV lift, believed to have been on sale for more than one year prior to the filed of the present application.
Photo of Allstar Performance Race Car Lift with Pump believed to have been on sale prior to invention by applicant.

* cited by examiner

PORTABLE AUTOMOBILE LIFT

This application claims the benefit of Provisional Patent Application No. 62/032,312 filed Aug. 1, 2014 and is a continuation-in-part of U.S. Design Patent Application No. 29/467,149 filed Sep. 16, 2013.

BACKGROUND OF THE INVENTION

Field of the Invention

This invention relates to automobile service lifts, and in particular to a portable low-rise lift which can be easily moved between locations.

Description of the Related Art

A wide variety of automobile lifts have been previously known and used in the automobile repair business and by hobbyists to provide access to the underside of a vehicle. Known varieties of lifts include post lifts and low-rise lifts. Post lifts can be either of the in-ground or above-ground variety, and are usually permanently installed in a fixed location. U.S. Pat. No. 8,256,577 discloses a portable two post lift having portable lifting columns which can be moved into a work area, bolted to the ground for use, and then unbolted and moved back into storage. The portable lifting columns are powered by a portable power unit which supplies hydraulic fluid to actuators in the lifting columns through a flow divider.

Low-rise lifts generally include a pair of jack assemblies, each of which includes a base, a support platform and links which connect the support platform to the base. Known low-rise lifts include the Bend-Pak P-6B pit style lift (generally as disclosed in U.S. Design Pat. No. D375,602) and the Bend-Pak LR-60 and LR-60P low-rise lifts. The P-6B lift includes two jack assemblies which are designed to be permanently mounted to a floor on opposite sides of a pit. Each assembly includes a respective actuator for raising the support platform relative to the base. Heavy coil springs are employed for lowering the support platforms. Designed primarily for use in quick oil change facilities, the jack assemblies of the P-6B are relatively heavy and not easily portable. The LR-60 has two jack assemblies interconnected by a linkage which spans the space between the two assemblies and connects both of the bases to each other and both of the support platforms to each other. A single actuator connected to the linkage serves to raise both support platforms in unison. The LR-60P is a portable version of the LR-60 having transport wheels and a tow handle for moving the lift between nearby work bays. Neither the LR-60 nor the LR-60P is easily portable between facilities. Also, while ideal for wheel service and body work, the interconnecting linkage of the LR-60 and LR-60P at least partially obstructs access the center underside of the vehicle and therefore makes these lifts impractical for transmission, drive line and exhaust work, for example.

What is needed is a low-rise lift which is lightweight, easily portable between work areas, including widely separated work areas, and which has no center structure or linkage which obstructs access to the center underside of a vehicle supported on the support platforms.

SUMMARY OF THE INVENTION

The present invention includes a jack assembly for a portable automobile lift. The jack assemblies are typically used in pairs to lift an automobile, but a single jack assembly can be utilized as a motorcycle lift. The jack assembly includes a base, a support platform and a pair of links connecting the base to the support platform. A hydraulic actuator connected between the base and the support platform is operable to move the support platform between a lowered position adjacent to the base and at least one raised position wherein the support platform is raised relative to the lowered position. In one embodiment, the actuator has base end and rod end hydraulic ports with a first one of the ports connected to a source of hydraulic fluid (such as a portable power unit to be described below) and a power assist canister is connected to the other port. The power assist cannister holds a charge of pressurized compressible fluid, such as compressed air. When hydraulic fluid is supplied to the first one of the ports, pressure acts on a first side of the actuator piston and causes the support platform to rise. The pressurized compressible fluid from the power assist canister assists in lowering of the support platform by exerting a force on a second side of the actuator piston while the hydraulic fluid is being drained away from the first side of the piston.

The jack assembly may also include a safety lock system which includes a lock bar pivotally attached to the support platform and one or more pockets fixedly attached to the base. The pockets are positioned to receive a free end of the lock bar when said support platform is in a respective on of its raised positions and thereby prevent downward movement of the support platform. The safety lock system, for example, may include two pockets, one of which receives the free end of the lock bar when the support platform is in a fully raised position and the other of which receives the free end of the lock bar when the support platform is in a partially raised position.

The support platform may include a pair of trays which each receive respective resilient contact blocks. The contact blocks provide the points of contact between the jack assembly and the underside of a vehicle. As the support platform is raised, the contact blocks engage support structure on the underside of the vehicle. Each contact block is preferably part of a set of contact blocks wherein the blocks in the set have varying thicknesses. The contact blocks may also have faces with interlocking features, such as corrugations, which allow multiple ones of the contact blocks to be interlockingly stacked on a tray. By selecting contact blocks with appropriate thicknesses or by stacking contact blocks, a user can compensate for any unevenness in the height of the support structure on the underside of the vehicle. One or more of the trays on a support platform also preferably have a length sufficient to allow the respective contact block to be repositioned in a longitudinal direction relative to the support platform along the length of the tray. This allows the contact blocks to be easily aligned with the respective support structure.

The jack assembly may also include transport wheels which allow it to be easily rolled from one location to another. In one embodiment, one or more transport wheels are mounted to the jack assembly proximate a hinge formed between one of said parallel links and either the support platform or the base that comprises an outer extremity of the jack assembly when the jack assembly is in the lowered position. The jack assembly can then be tilted upwardly with the transport wheels on the ground and then rolled between locations.

When the jack assembly is used as part of a portable automobile lift, pressurized hydraulic fluid is supplied to a pair of jack assemblies by a portable power unit, which includes a fluid reservoir, a pump for circulating an pressurizing the fluid, and a motor for driving the pump. The power unit may further includes a flow divider providing synchronized movement of both said jack assemblies even if uneven weight acting on said support platforms results in said actuators being unequally loaded.

DETAILED DESCRIPTION OF THE PREFERRED EMBODIMENTS

Figure 1:
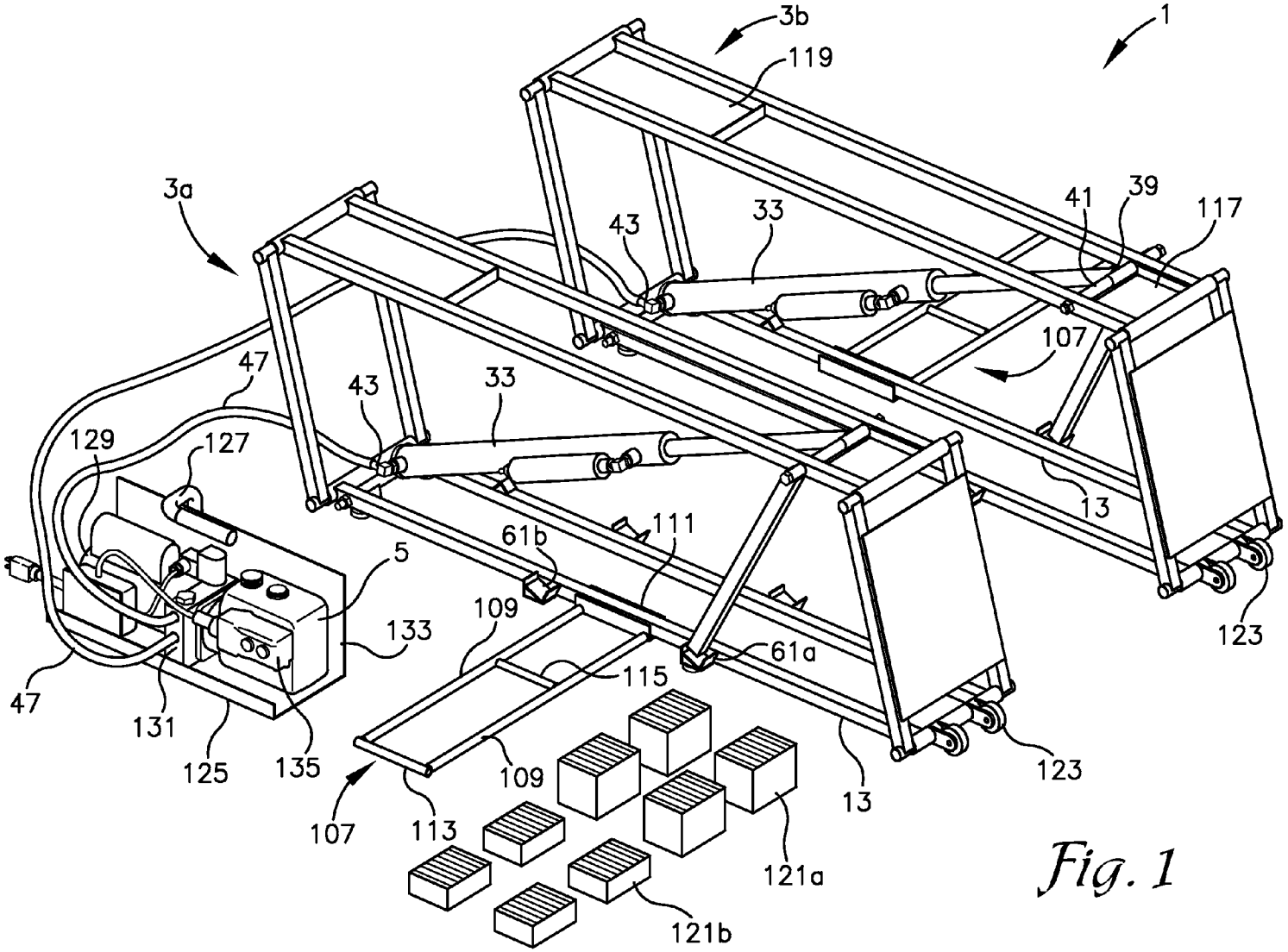
FIG. 1 is a perspective view of a portable automobile lift according to the present invention.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Certain terminology will be used in the following description for convenience in reference only and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings in more detail, and in particular to FIG. 1, the reference number 1 generally designates a portable automobile lift according to the present invention. The lift 1 includes a pair of jack assemblies 3 and a power unit 5. The two jack assemblies 3, which may be designated as jack assemblies 3*a* and 3*b*, are preferably substantially identical to each other but (as will be described in more detail below) may be assembled in such a way as to be, in some aspects, mirror images of each other. It is foreseen that a single jack assembly 3 can be employed as a motorcycle lift.

Referring to FIGS. 2-5, each jack assembly 3 includes a base 7, a support platform 9 and a pair of parallel links 11 which connect the support platform 9 to the base 7. The base 7 is generally rectangular and includes a pair of side rails 13 which are connected at their opposed ends to a pair of end tubes 15. Similarly, the support platform 9 is generally rectangular and includes a pair of side rails 17 which are connected at their opposed ends to a pair of end tubes 19. Each of the parallel links 11 comprises a pair of legs 21 connected proximate their lower ends to a lower end tube 23 and proximate their upper ends to an upper end tube 25. The lower end tubes 23 of the parallel links 11 are each rotatably received within a respective one of the end tubes 15 of the base 7 to form respective lower hinges 27. Similarly, the upper end tubes 25 of the parallel links 11 are each rotatably received within a respective one of the end tubes 19 of the support platform 9 to form respective upper hinges 29. The legs 21 are positioned outside of the side rails 13 and 17.

Figure 2:
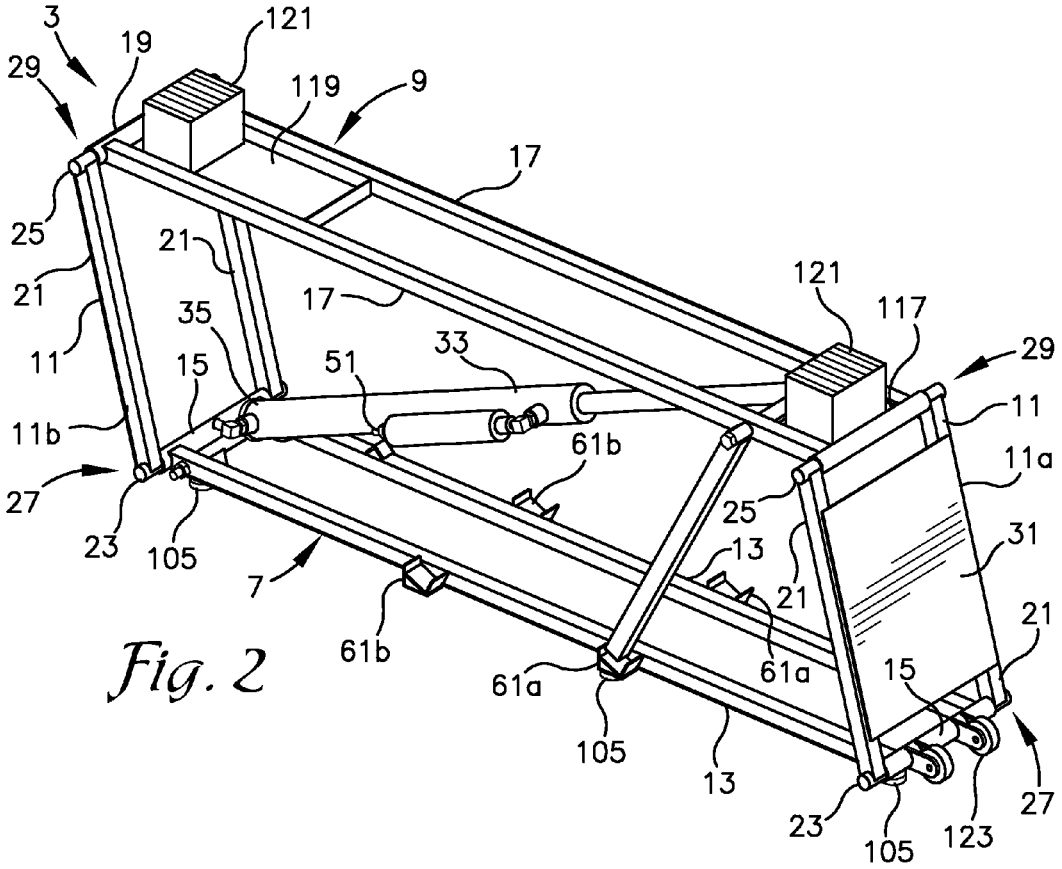
FIG. 2 is a perspective view of a first embodiment of a jack assembly which forms a part of the portable automobile lift of FIG. 1 shown in a raised position.
Figure 3:
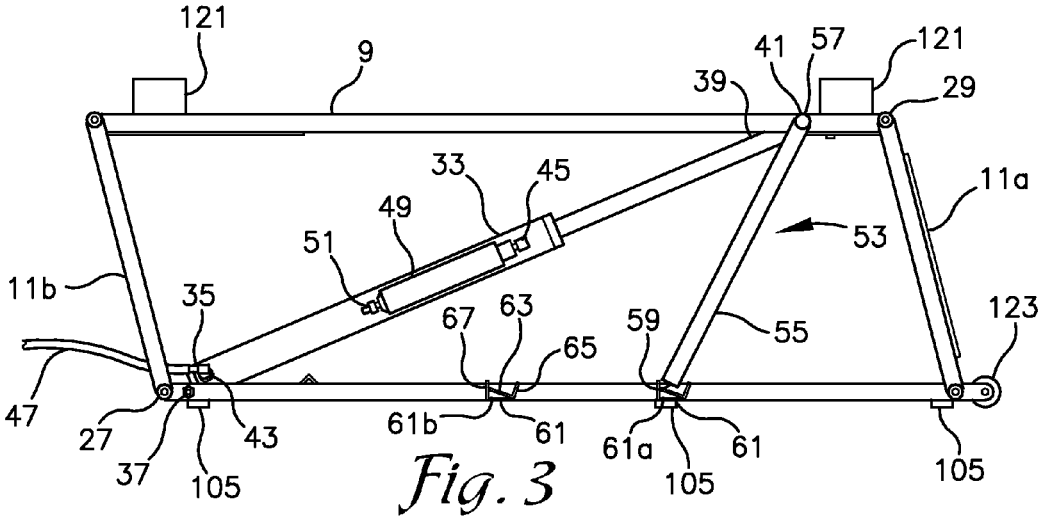
FIG. 3 is a left side elevational view of the jack assembly of FIG. 2.
Figure 4:
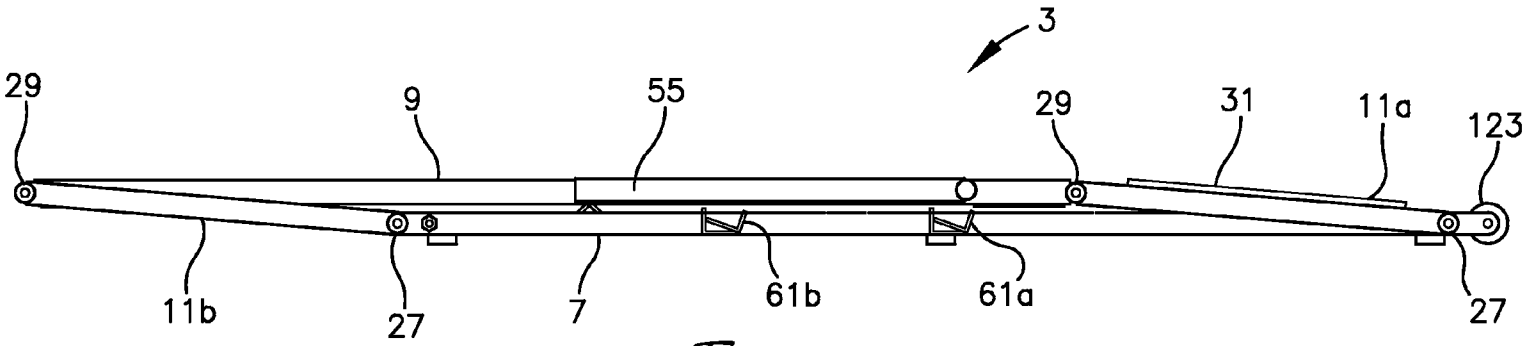
FIG. 4 is a view similar to FIG. 3 showing the jack assembly of FIG. 2 in a lowered position.
Figure 5:
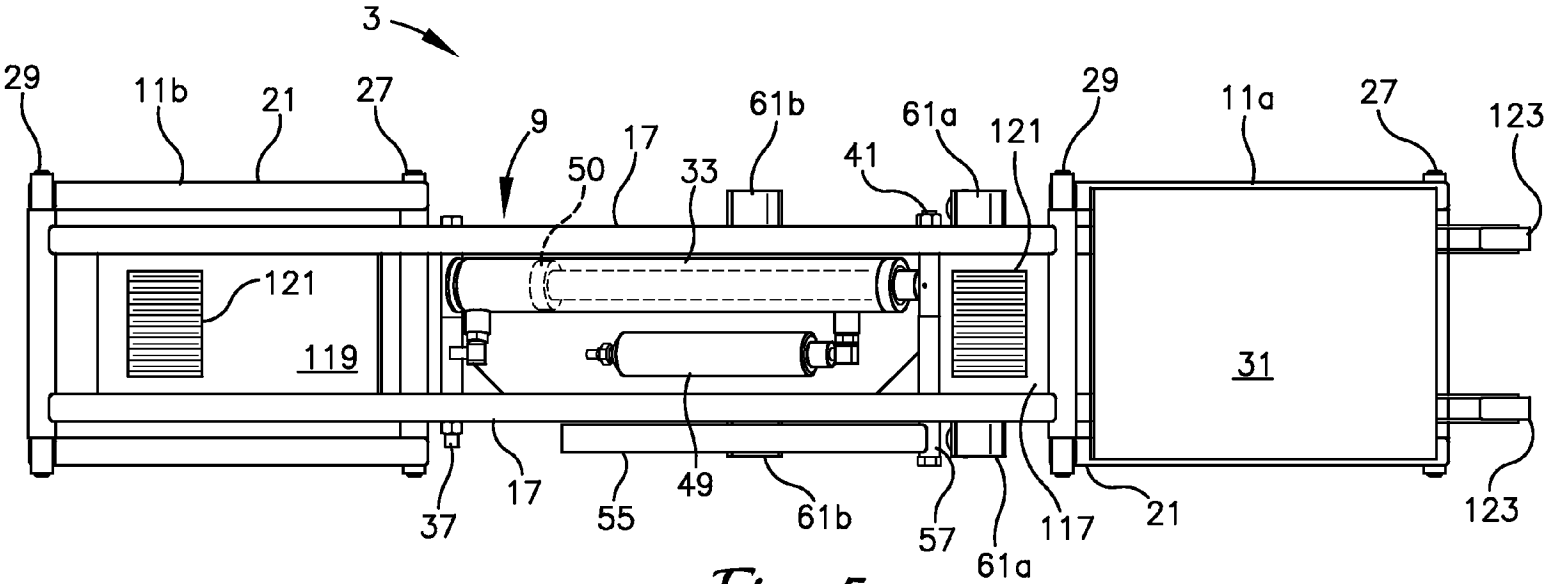
FIG. 5 is a top plan view of the jack assembly of FIG. 2 in the lowered position.

Each jack assembly 3 is generally in the form of a parallelogram and is moveable from a lowered position (as shown in FIGS. 4 and 5), wherein the support platform 9 is positioned adjacent to the base 7, and one or more raised positions (as shown in FIGS. 2 and 3) wherein the support platform 9 is spaced upwardly from the base 7 at a greater spacing than the spacing in the lowered position. The lowered position of each jack assembly 3 may be defined as the position wherein the support platform 9 is at its lowest orientation relative to the base 7 within the mechanical limits of the jack assembly 3. As used herein, reference to the support platform 9 being positioned adjacent to the base 7 includes a positional relationship in which the support platform 9 abuts against the base 7 or in which the spacing between the support platform 9 and the base 7 is relatively small. In one embodiment, the spacing between the support platform 9 and the base 7 in the lowered position is an inch or less, so that the overall height of the jack assembly 3 in the lowered position is kept to a minimum. The one or more raised positions may include a fully raised position and one or more partially raised positions.

As the support platform 9 moves downwardly from the fully raised position toward the lowered position, it also moves in a longitudinal direction relative to the base 7. Simultaneously, a first one of the parallel links 11, which may be designated as first parallel link 11*a*, overlies a portion of the base 7 and the support platform 9 overlies the other parallel link 11, which may be designated as second parallel link 11*b*. The first parallel link 11*a*, which overlies the base 7 when the jack assembly 3 is in the lowered position, includes a plate 31 connected to the outer surfaces of its legs 21. The plate 31 becomes an upper surface of the jack assembly 3 when the jack assembly 3 is in its lowered position.

Movement of each jack assembly 3 between the lowered and raised positions is powered by a linear actuator, such as a hydraulic actuator 33. As seen in FIGS. 2 and 3, each actuator 33 has a base end 35 connected to a lower pivot mount 37 connected between the side rails 13 of the respective base 7 and a rod end 39 connected to an upper pivot mount 41 connected between the side rails 17 of the respective support platform 9. The lower pivot mount 37 is adjacent to and spaced inward from the lower hinge 27 which attaches second parallel link 11*b* to the base 7. The upper pivot mount 41 is spaced longitudinally inward along the side rails 17 from the upper hinge 29 which attaches the first parallel link 11*a* to the support platform 9.

The actuators 33 are powered by the power unit 5 and may be either single-acting or double-acting hydraulic actuators. In the embodiments shown, the actuators 33 are constructed as double-acting actuators having a base end hydraulic port 43 and a rod end hydraulic port 45, but each only has a single hydraulic line 47 connected to the base end port 43 thereof for extending the respective actuator 33 and raising the respective jack assembly 3 toward a raised position. Retraction of the actuators 33 and downward movement of jack assemblies 3 is powered by gravity and may be assisted by a "power assist canisters" 49, such as accumulators, air bottles or the like connected to the rod end hydraulic ports 45 of the actuators 33. The power assist canisters 49 each hold a charge of a pressurized compressible fluid, such as compressed air which acts to push the piston 50 of the respective actuator 33 downwardly and speed downward movement of the jack assemblies 3. Each power assist canister 49 includes a valve 51, such as an air valve, for attaching a hose to add compressible fluid to the charge.

Each jack assembly 3 is further provided with a safety lock system 53 for retaining the support platform 9 thereof in its one or more respective raised positions. The safety lock system 53 includes a safety lock bar 55 which is pivotally attached to the support platform 9 by a pivot mount 57, which is shown as being coextensive with the upper pivot mount 41 for the rod end 39 of the actuator 33. The safety lock bar 55 extends downwardly from the support platform 9 to a free end 59. Mounted on the base 7 are one or more pockets 61 for receiving the free end 59 of the safety lock bar 55. Each of the pockets 61 is sized and shaped to accept and retain the free end 59 of the lock bar 55 so as to prevent the support platform 9 from moving downwardly beyond the selected raised position. Each pocket 61 thus includes a floor 63 which abuts against the free end 59 of the lock bar 55 and a backstop 65 which prevents the lock bar 55 from swinging past the pocket 61 under the force of gravity.

Each jack assembly 3 is shown as having a pair of pockets 61 connected to and extending outwardly from an outer one of the side rails 13 of the base 7. A first pocket 61*a* is positioned to receive the free end 59 of the lock bar 55 and retain the jack assembly 3 in the fully raised position. A second pocket 61*b* is longitudinally spaced from the first pocket 61*a* and is positioned to receive the free end 59 of the lock bar 55 and retain the jack assembly 3 in a partially raised position. It is foreseen that more than two pockets 61 could be provided on the outer side of the base 7 if it is desired to retain the jack assembly 3 in more than one partially raised position. It is also foreseen that only a single pocket 61 could be provided on the outer side of the base 7 if it is only desired to retain the jack assembly 3 in a single position, such as the fully raised position. Pockets 61 may also be mounted in corresponding positions on the inside one of the side rails 13 of the base 7 so that a jack assembly 3 can be used on either side of a vehicle (as jack assembly 3*a* or as jack assembly 3*b*) simply by switching the mounting point for the lock bar 55 to the other side of the support platform 9. If so constructed, the jack assembly 3 will have two pockets 61*a* and two pockets 61*b*.

Figure 6:
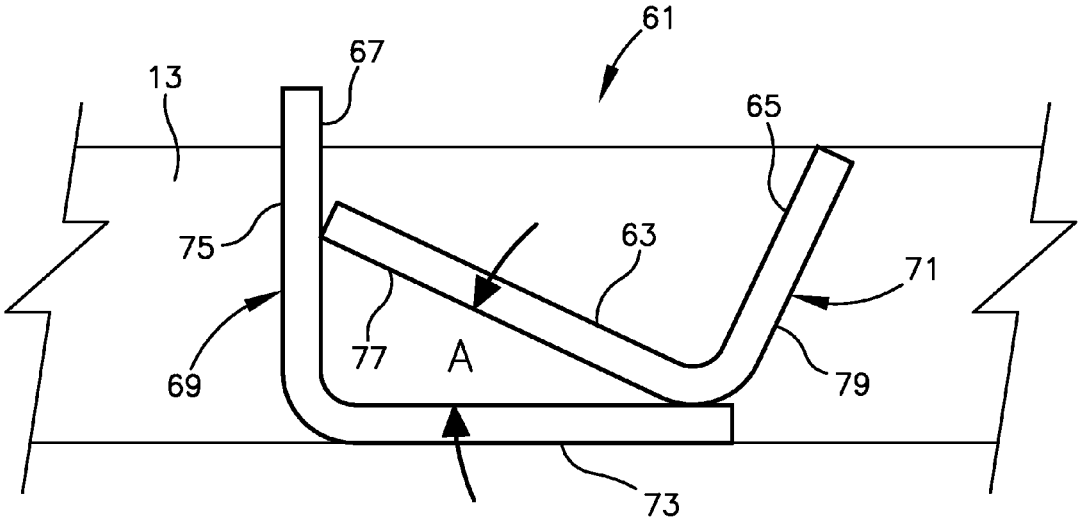
FIG. 6 is an enlarged, fragmentary view of the jack assembly of FIG. 2 showing a safety lock pocket thereof.

In the embodiment of the jack assembly 3 shown in FIGS. 2-5, the pockets 61 are each formed from two brackets 69 and 71 formed from respective pieces of angle stock having perpendicular first and second flanges. The construction of one of the pockets 61 is shown in greater detail in FIG. 6. Bracket 69 is mounted with a first flange 73 thereof oriented generally horizontally (in parallel to the side rail 13 to which it is attached) and a second flange 75 extending generally vertically upward therefrom. Bracket 71 is mounted with a first flange 77 thereof overlying the first flange 73 of bracket 69 at an angle A thereto and a second flange 79 extending upwardly therefrom in a position opposite the second flange 75 of bracket 69. The first flange 77 of bracket 71 forms the floor 63 of the respective pocket 61 and the second flange 79 forms the backstop 65. Angle A is selected to place the floor 63 in a position generally perpendicular to the free end 59 of the lock bar 55 when the free end 59 is received in the pocket 61. The second flange 75 of bracket 69 forms a detent 81 which impedes the lock bar 55 from being inadvertently withdrawn from the pocket 61.

Figure 7:
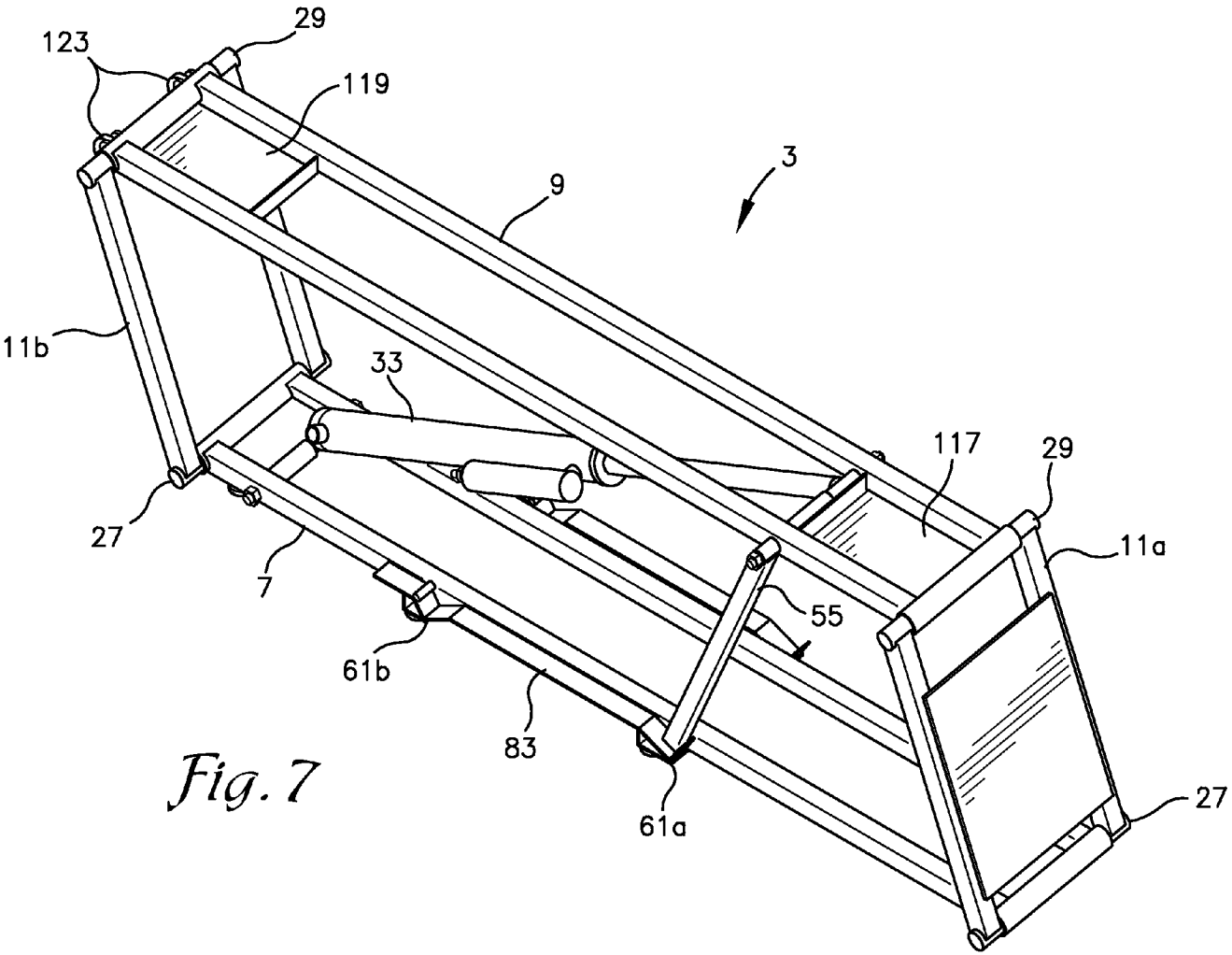
FIG. 7 is a perspective view of a second embodiment of the jack assembly shown in the raised position.
Figure 8:
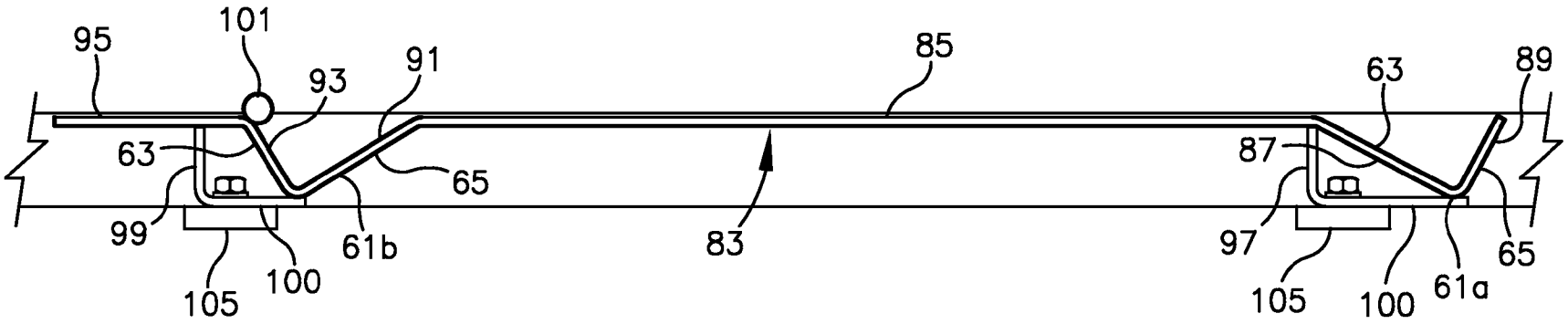
FIG. 8 is an enlarged, fragmentary view of the jack assembly of FIG. 7 showing a safety lock pocket assembly thereof.

In another embodiment of the jack assembly 3, shown in FIG. 7, the pockets 61*a* and 61*b* on a side of a respective jack assembly 3 may both be features of a single pocket assembly 83 formed from a piece of flat stock secured to the respective side rail 13 and bent to form the pockets 61*a* and 61*b*. As shown in FIG. 8, pocket assembly 83 includes a center section 85 which spans the longitudinal space between the pockets 61*a* and 61*b*. A first downwardly angled section 87 forms the floor 63 of pocket 61*a* and a first upwardly angled section 89 forms the backstop 65 of pocket 61*a*. Similarly, a second downwardly angled section 91 forms the backstop 65 of pocket 61*b* and a second upwardly angled section 93 forms the floor of pocket 61*b*. Pocket assembly 83 may further include a horizontal tail section 95 which reinforces the second upwardly angled section 93. Pocket 61*a* may be further reinforced by a first angle bracket 97 positioned below the first downwardly angled section 87 and pocket 61*b* may be further reinforced by a second angle bracket 99 positioned below the second upwardly angled section 93. Each of the angle brackets 97 and 99 presents a respective horizontal flange 100. A pin 101 which extends outwardly from the side rail 13 at the upper extremity of the second upwardly angled section 93 forms a forms a detent 103 which impedes the lock bar 55 from being inadvertently withdrawn from the pocket 61*b*.

The base 7 of each jack assembly 3 is provided with feet 105 which support the base 7 on a level ground surface. The feet 105 may be formed of nylon or a similar material to allow the jack assemblies 3 to be slid relatively easily across the ground surface under no-load conditions but still grip the ground surface for stability when the jack assemblies 3 are loaded. Two pairs of feet 105 are mounted to the side rails 13 proximate the lower hinges 27 and additional feet 105 may be mounted on the flanges 73 of pockets 61*a* of the embodiment shown in FIGS. 2-5 or on the horizontal flanges 100 of angle brackets 97 and 99 in the embodiment shown in FIGS. 7 and 8.

Referring again to FIG. 1, removable handles 107 are provided for each of the jack assemblies 3 and are used for sliding the jack assemblies 3 into position under a vehicle and for withdrawing the jack assemblies 3 from under the vehicle. The handles 107 may be, for example, removably attached to the outside one of the side rails 13 of the base 7 of the respective jack assembly 3. Each handle 107 is shown as including a pair of legs 109, a hook 111 secured to first ends of the legs 109, and a crossbar 113 secured to opposite, second ends of the legs 109. The hook 111 comprises a channel member sized and shaped to grip the outside side rail 13 and the crossbar 113 is sized for gripping by the hand of a user. An intermediate crossbar 115 may be secured to the legs 109 between the hook 111 and crossbar 113 for structural support and as a secondary gripping member.

Each support platform 9 includes first and second trays 117 and 119, respectively, formed between the side rails 17 thereof. The first tray 117 is positioned between the upper pivot mount 41 and the upper hinge 29 which attaches the first parallel link 11*a* to the support platform 9. The second tray 119 has an end located proximate the upper hinge 29 which attaches the second parallel link 11*b* to the support platform. The trays 117 and 119 are adapted to receive sets of interchangeable contact blocks 121 which form the contact surfaces between the jack assemblies 3 and the underside of a vehicle to be lifted. The contact blocks 121 are preferably formed of a non-marring and non-slip material, such as neoprene, natural rubber, or the like. The interchangeable contact blocks 121 are of varying thicknesses and may, for example, include a set of thick contact blocks 121*a* and a set of thin contact blocks 121*b*. The contact blocks 121 each have upper and lower surface having corrugations which interlock with each other so as to make the contact blocks 121 stackable and interlocking One or more of the trays 117 and 119 may be sized to allow a contact block 121 positioned therein to be moved longitudinally along the length of the tray.

Each of the jack assemblies 3 may be provided with a pair of transport wheels 123 used when moving the jack assemblies 3 between locations, such as storage and use locations. The wheels 123 are mounted to the respective jack assembly 3 proximate one of the hinges 27 or 29 that forms an outer extremity of jack assembly 3 when it is in the lowered position. In FIGS. 2-5 the wheels 123 are shown mounted to the base 7 proximate the lower hinge 27 which attaches first parallel link 11*a* to the base 7. In FIG. 7 the wheels 123 are mounted to the support platform 9 proximate the upper hinge 29 which attaches second parallel link 11*b* to the support platform 9. It is foreseen that a single elongated wheel or roller could be used in place of the pair of wheels 123 shown.

Referring again to FIG. 1, hydraulic power for the jack assemblies 3 is provided by the power unit 5, which is mounted on a carrier 125 having a handle 127. The power unit 5 includes a motor 129 (which may be an AC electric motor or a 12 volt DC electric motor) which drives a hydraulic pump 131 which circulates hydraulic fluid from a reservoir 133. The pump 131 includes an integral flow divider which directs flow from the pump 131 to the two jack assemblies 3. The flow divider is preferably a rotary gear flow divider adapted to provide synchronized movement of the two jack assemblies 3 even if uneven weight acting on the support platforms 9 results in unequally loaded hydraulic actuators 33. The motor 129 is provided with a remote control, such as a pendant remote 135, with appropriate control buttons for powering the pump 131 to extend or retract the cylinders 33.

The flow divider of the pump 131 provides a pair of outlets each of which includes a respective quick-connect hydraulic fitting which, in turn, couples to a mating fitting on a first end of a respective one of the hydraulic lines 47. Similarly, the second end of each hydraulic line 47 also includes a quick-connect fitting which couples to a mating fitting associated with the base end port 43 of a respective one of the actuators 33.

In use, the jack assemblies 3 are first moved into a work area with access to a vehicle (not shown). The work area may be, for example, a garage, a driveway or a race track pit area. The jack assemblies 3 may be rolled to the work area on their respective wheels 123 with the opposite end supported by a user in a manner similar to a wheeled suitcase or an appliance dolly. The power unit 5 is fluidly connected to both jack assemblies 3 by hydraulic lines 42 using the respective quick-connect fittings. On initial set-up, the reservoir 133 will need to be filled with hydraulic fluid and the power assist canisters 49 pressurized from a compressible fluid source, such as an air-compressor, pump or portable air tank. If the power unit 5 utilizes an AC motor 129, an associated power cord is plugged into a suitable wall outlet.

Figure 9:
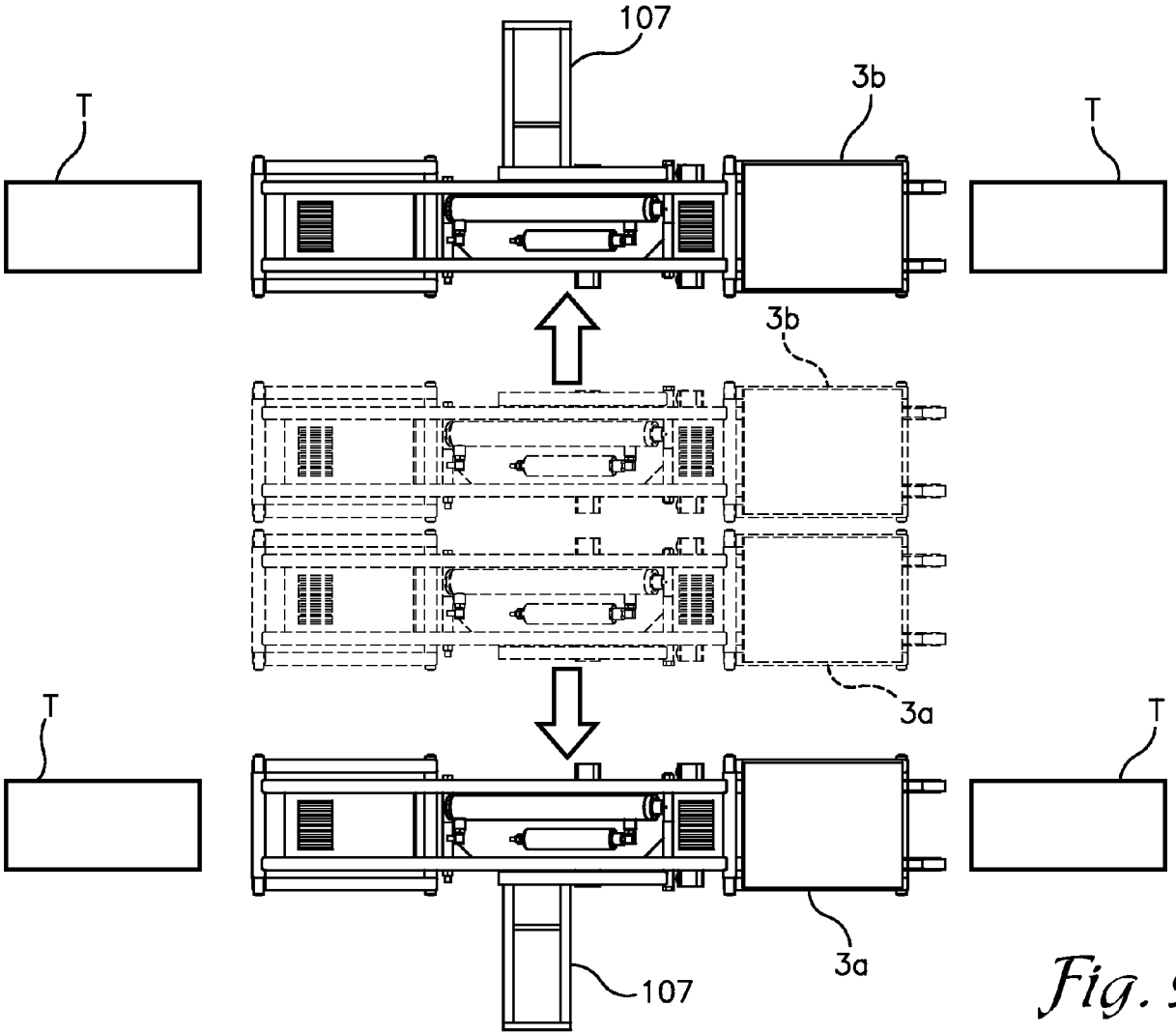
FIG. 9 is a top plan view of a pair of jack assemblies showing movement of the jack assemblies from a central position shown in phantom lines to a working position shown in solid lines.
Figure 10:
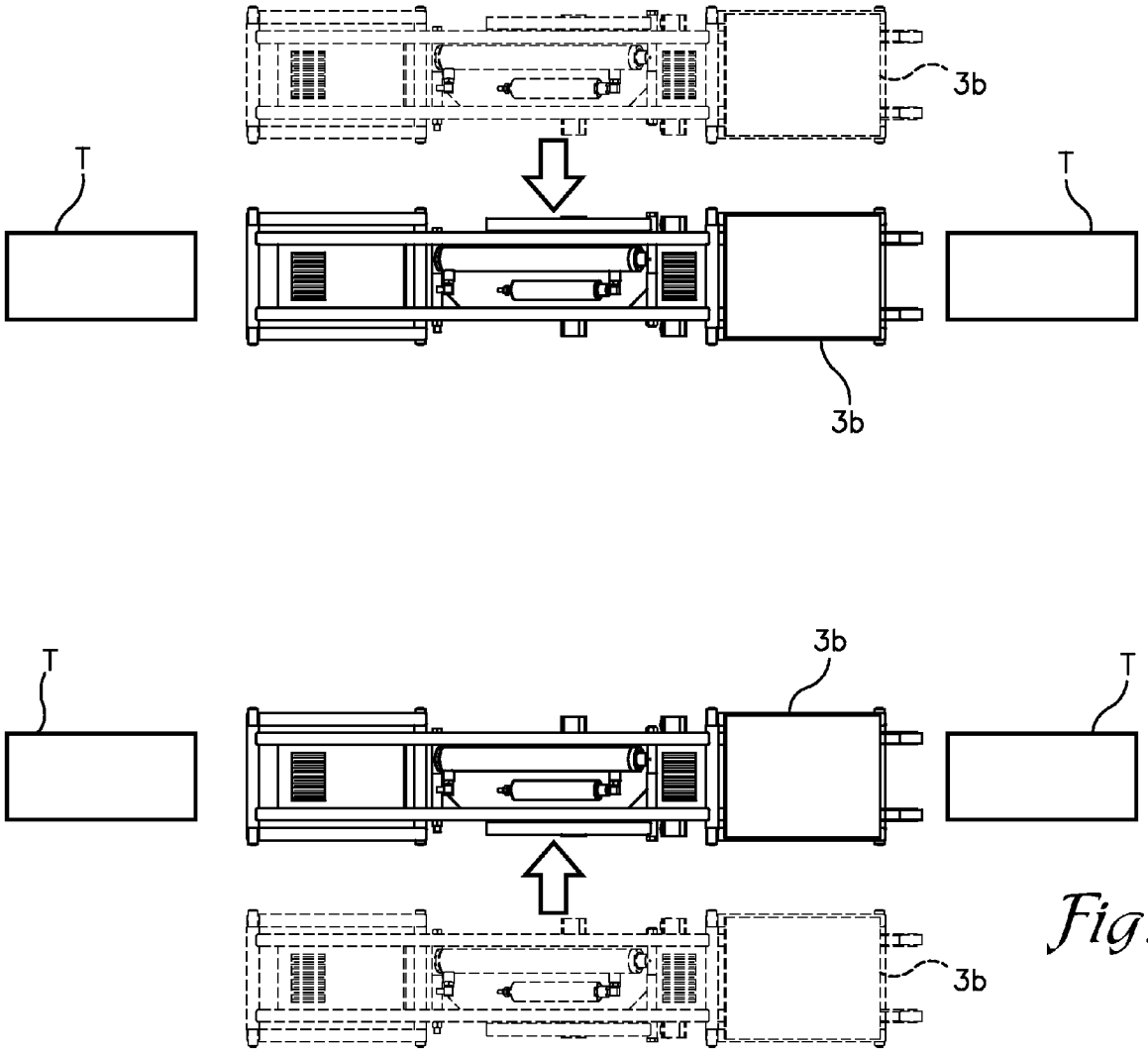
FIG. 10 is a view similar to FIG. 9 showing movement of the jack assemblies from an outside position shown in phantom lines to a working position shown in solid lines.

The jack assemblies 3 are first retracted into their lowered positions and placed in parallel longitudinal relation to each other, either close together in a central position (as shown in phantom lines in FIG. 9) so that the vehicle can be driven over them with the tires T of the vehicle straddling the jack assemblies 3, or spaced apart from each other in an outside position (as shown in phantom lines in FIG. 10) so that the vehicle can be driven between them. The vehicle is then moved into position over or between the jack assemblies 3. The jack assemblies 3 are then moved either outwardly from the center position or inwardly from the outside position (by sliding the feet 105 across the ground surface) until the jack assemblies 3 are located in a working position wherein the trays 117 and 119 are positioned under appropriate jacking structure on the vehicle (generally as shown in solid lines in FIGS. 9 and 10). The removable handles 107 may be attached to the jack assemblies 3 and employed for sliding the jack assemblies 3 into the working position if conditions make their use beneficial. Note that, in the working position, an open area is preferably left between the jack assemblies 3 for access to the underside of the vehicle.

Contact blocks 121 are placed in the trays 117 and 119 and are positioned to make contact with the jacking structure of the vehicle upon upward movement of the support platforms 9. If the tray 117 or tray 119 has sufficient length, the contact blocks 121 may be slid along the respective trays 117 or 119 to align with the appropriate jacking structure. If the jacking structure over one of the trays 117 or 119 is higher than the jacking structure over the other tray 117 or 119 then a thicker contact block 121*a* may be used in that tray or multiple contact blocks 121 may be stacked. If the jacking structure over a respective tray 117 or 119 is lower than the jacking structure over the other tray 117 or 119 then a thinner contact block 121*b* may be used. By manipulating the contact blocks 121 in this manner, the contact blocks 121 can be arranged to make generally simultaneous contact with the respective jacking structure as the support platforms 9 are raised. If the power unit 5 utilizes a 12 volt DC motor 129, an associated power cord with appropriate battery clips is connected to the battery of the vehicle being lifted or to another 12 volt power source.

Using the buttons on the remote control 135, the motor 129 can now be actuated to engage the hydraulic pump 131 to extend the actuators 33 and thereby lift the support platforms 9. As the actuators 33 extend and the support platforms 9 lift, the contact blocks 121 make contact with the jacking structure on the underside of the vehicle. Continued extension of the actuators 33 causes the vehicle to be lifted off of the ground surface. Note that as the actuators 33 extend, the action of the actuator pistons 50 further compresses the compressible fluid trapped between the piston 50 and the respective power assist canisters 49 and thereby adds to the power which the power assist canisters 49 can exert upon lowering of the support platforms 9.

Once the support platforms 9 (and the vehicle supported thereon) reach a desired height, the safety lock bars 55 are both pivoted downwardly until their free ends 59 each engage an appropriately positioned pocket 61, such as pocket 61*a* or pocket 61*b*. The support platforms 9 may have to be raised or lowered somewhat to facilitate engagement of the free ends 59 with the respective pockets 61. Once the free ends 59 of the safety lock bars 55 are properly engaged with the pockets 61, the lock bars 55 will prevent the support platforms 9 from moving downwardly unexpectedly and it is safe for a user to service the vehicle, including servicing the underside of the vehicle between the jack assemblies 3.

Once the service is completed, the lock bars 55 can be disengaged from the pockets 61 and the buttons on the remote control can be operated to open valves associated with the hydraulic pump 131 and allow fluid to escape from the actuators 33 back to the reservoir 133, thereby allowing the actuators 33 to retract under the weight of the vehicle and the support platforms 9 lower. Once the tires of the vehicle reach the ground surface, the weight acting on the actuators 33 is diminished and lowering of the support platforms 9 would potentially be slowed or stalled except that pressure from the power assist canisters 49 continues to act on the pistons 50 of the actuators 33 and causes retraction to continue. When the jack assemblies 3 are fully lowered, they can be slid out from under the vehicle to the outside position or slid inwardly to the center position and the vehicle driven away (after disconnecting the 12v DC power cable if one was used). The jack assemblies can then be disconnected from the hydraulic lines 47 and rolled back to a storage area on their wheels 123. Similarly, the hydraulic lines 47 can be disconnected from the power unit 5 and the power unit 5, hydraulic lines 47, contact blocks 121, and handles 107 can be collected and put away.

Accessory Mounting

Figure 11:
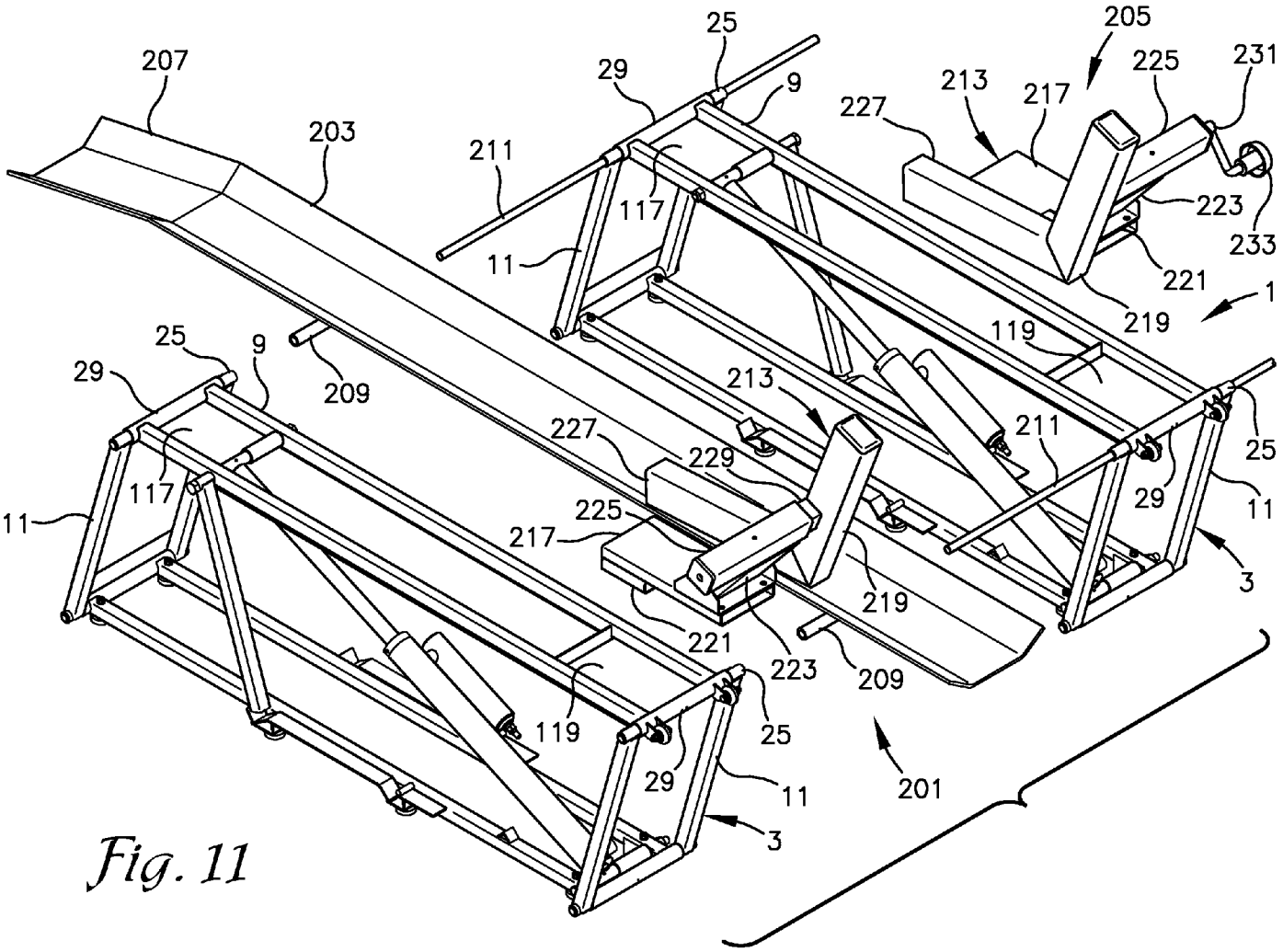
FIG. 11 is an exploded perspective view of a portable automobile lift according to the present invention shown in combination with a motorcycle adapter mountable thereto.
Figure 12:
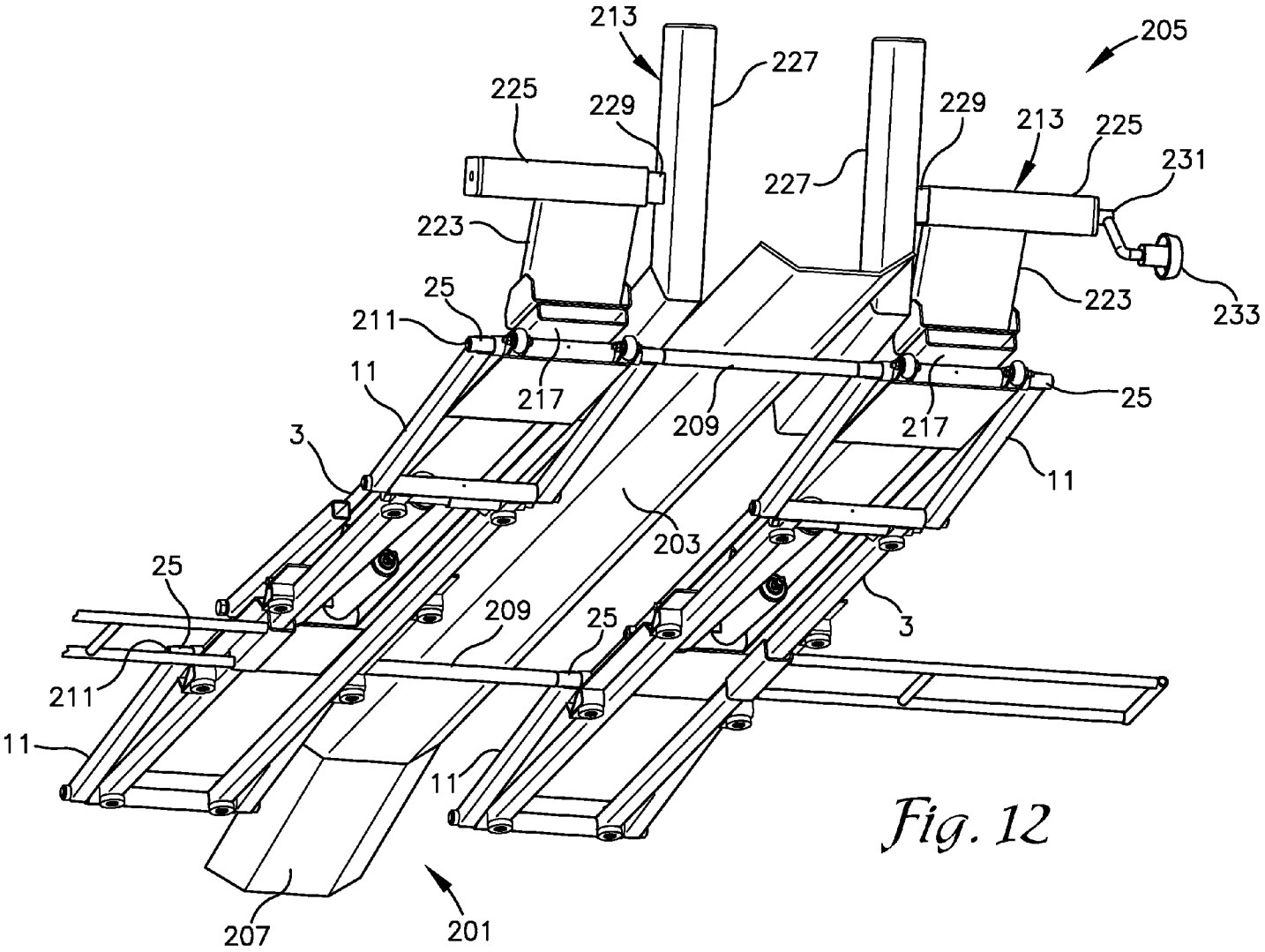
FIG. 12 is a bottom perspective view of the combination of FIG. 11 showing the motorcycle adapter connected to the portable automobile lift.

As shown in FIGS. 11 and 12, the lift 1 may be equipped with an accessory, such as a motorcycle adapter 201. The motorcycle adapter 201 includes a wheel trough 203 and a clamp assembly 205, and is mounted to the lift 1 with the wheel trough 203 positioned between the support platforms 9 of the jack assemblies 3 and the clamp assembly 205 supported on the support platforms 9. The wheel trough 203 comprises an upwardly open channel member sized to receive the tires of a motorcycle (not shown) and includes an angled ramp section 207 which allows the motorcycle to be more easily rolled (or ridden) up onto the lift 1. Secured to the wheel trough 206 are a pair of transverse securement tubes 209 which are positioned for alignment with the upper hinges 29 of the two jack assemblies 3. The securement tubes 209 each have an inside diameter which is consistent with an inside diameter of the upper end tubes 25 of the parallel links 11 which form the inner portion of the upper hinges 29. The motorcycle adapter 201 is secured to the lift 1 by rods 211 which extend through the securement tubes 209 and through the respective upper end tubes 25 of the parallel links 11 of both jack assemblies 3.

The clamp assembly 205 serves to clamp onto a wheel of a motorcycle positioned on the wheel trough 203 and includes a pair of clamp halves 213. Each clamp half 213 includes a respective base 217 and a laterally moveable jaw 219. Each base 217 mounts over the respective jack assembly 3 and includes a downwardly extending boss 221 which is received in a respective one of the pockets 117 or 119 (119 shown) thereof. Each base 217 further includes a riser 223 and a laterally extending outer telescope tube 225 mounted atop the riser 223. Each jaw 219 includes a generally L-shaped contact member 227 and a inner telescope tube 229 extending laterally outward therefrom. Each inner telescope tube 229 is selectively slideably received within the respective outer telescope tube 225.

At least one of the clamp halves 213 preferably includes a crank assembly 231 operable to move the respective jaw 219 relative to the base 217 thereof. The crank assembly 231 can, for example, include a threaded axial rod which threadably engages structure (not shown) associated with the inner telescope tube 229 to move the inner telescope tube 229 relative to the outer telescope tube 225 upon rotation of a crank handle 233 attached thereto. The other clamp half 213 may have an inner telescope tube 229 which can be selectively positioned relative to the respective outer telescope tube 225 using a locating pin or the like.

It is to be understood that while certain forms of the present invention have been illustrated and described herein, it is not to be limited to the specific forms or arrangement of parts described and shown. For example, it is foreseen that each actuator 33 could be reversed such that the rod end 39 is connected to the base 7 and the base end 35 is connected to the support platform 9 without departing from the scope of the invention. It is also foreseen that an end of the each of actuators 33 could be connected to the respective link 11*a* instead of being connected directly to the support platform 9. The phrase "connected between the base and support platform" and its equivalents should be construed to include such a mounting of the actuator since the force produced by extension of the actuator is transferred to the support platform through the link 11*a*. Similarly, it is foreseen that the actuator 33 could be mounted with one end connected to the base 7 and the other end connected to the link 11*b*, or to the support platform 9 proximate the link 11*b*, such that retraction of the actuator 33 causes the support platform 9 to rise and extension of the actuator 33 causes the support platform 9 to lower. In this latter case, the hydraulic lines 47 would be connected to the rod end ports 45 and the power assist canisters 49 would be connected to the base end ports 35. It is also foreseen that certain features of the current invention are applicable to lifts having links 11 which are not parallel to each other as shown, but in other orientations to each other, including but not limited to an "X" configuration.

As used in the claims, identification of an element with an indefinite article "a" or "an" or the phrase "at least one" is intended to cover any device assembly including one or more of the elements at issue. Similarly, references to first and second elements, or to a pair of elements, is not intended to limit the claims to such assemblies including only two of the elements, but rather is intended to cover two or more of the elements at issue. Only where limiting language such as "a single" or "only one" with reference to an element, is the language intended to be limited to one of the elements specified, or any other similarly limited number of elements.

What is claimed and desired to be secured by Letters Patent is as follows:

1. A portable automobile lift including a pair of mechanically unconnected jack assemblies, each said jack assembly comprising:

a) a base, a support platform and a pair of links connecting said base to said support platform;

b) a hydraulic actuator connected between said base and said support platform and operable to move said support platform between a lowered position adjacent to said base and at least one raised position spaced above said base, said actuator having a piston, a base end port and a rod end port, a first one of said ports providing fluid communication between a source of pressurized hydraulic fluid and a first side of said piston for raising said support platform; and c) a power assist canister connected to said other of said ports of said actuator, said power assist canister holding a charge of pressurized compressible fluid, said pressurized compressible fluid exerting a force on a second side of said piston and assisting in lowering of said support platform when said pressurized hydraulic fluid is drained away from said first side of said piston.

2. The portable automobile lift as in claim 1 wherein each said jack assembly further includes a safety lock system comprising:

a) a lock bar pivotally attached to said support platform and having a free end; and b) a pocket fixedly attached to said base and positioned to receive said free end of said lock bar when said support platform is in one of said at least one raised positions and thereby prevent downward movement of said support platform.

3. The portable automobile lift as in claim 2 wherein:

a) said at least one raised position includes first and second raised positions;

b) said pocket is a first pocket;

c) said safety lock system further includes a second pocket attached to said base and longitudinally spaced along said base from said first pocket;

d) said first pocket is positioned to receive said free end of said lock bar when said support platform is in said first raised position and thereby prevent downward movement of said support platform from said first raised position; and e) said second pocket is positioned to receive said free end of said lock bar when said support platform is in said second raised position and thereby prevent downward movement of said support platform from said second raised position.

4. The portable automobile lift as in claim 3 wherein:

a) said first raised position is a fully raised position and b) said second raised position is a partially raised position.

5. The portable automobile lift as in claim 1 wherein each said support platform includes a tray and each said jack assembly further includes a resilient contact block receivable on the respective tray, each said contact block engageable with support structure on an underside of a vehicle.

6. The portable automobile lift as in claim 5 wherein said contact blocks are part of a set of contact blocks, the blocks in said set of contact blocks having varying thicknesses.

7. The portable automobile lift as in claim 6 wherein said blocks in said set of contact blocks have faces with interlocking features allowing multiple ones of said contact blocks to be interlockingly stacked on the respective tray.

8. The portable automobile lift as in claim 5 wherein each said tray has a length sufficient to allow the respective contact block to be repositionable in a longitudinal direction relative to the respective support platform along said length of said tray.

9. The portable automobile lift as in claim 5 wherein each said support platform includes two of said trays longitudinally spaced from each other along a length of the respective support platform and each said jack assembly includes at least two of said contact blocks receivable on the respective trays.

10. The portable automobile lift as in claim 1 wherein, when each said jack assembly is in said lowered position, a hinge formed between one of said parallel links and one of said support platform and said base comprises an outer extremity of the respective jack assembly and each said jack assembly further includes at least one transport wheel secured thereto proximate said hinge, said at least one transport wheel useable to roll the respective jack assembly from one location to another.

11. The portable automobile lift as in claim 1 and further including a portable power unit, said portable power unit serving as said source of pressurized hydraulic fluid for both jack assemblies, said portable power unit including a hydraulic pump in fluid communication with said first ones of said ports of said actuators of both said jack assemblies.

12. The portable automobile lift as in claim 11 wherein said portable power unit further includes a flow divider providing synchronized movement of both said jack assemblies even if uneven weight acting on said support platforms results in said actuators being unequally loaded.

13. The portable automobile lift as in claim 12 wherein said flow divider is integral with said hydraulic pump.

14. The portable automobile lift as in claim 1 in combination with an accessory, wherein:

a) said support platform of each said jack assembly is connected to each link in the respective pair of links by a respective hinge, each said hinge comprising an inner hinge tube rotatably received within an outer hinge tube;

b) said accessory includes a component positioned between said support platforms and including a pair of securement tubes positioned in alignment with said inner hinge tubes; and c) said component is secured to both of said jack assemblies by a pair of pins, each said pin extending through a respective one of said securement tubes and through an inner hinge tube of each said jack assembly.

15. The combination as in claim 14 wherein said accessory is a motorcycle adapter and said component is a wheel trough of said motorcycle adapter.

16. A jack assembly for a portable automobile lift, comprising:

a) a base, a support platform and a pair of links connecting said base to said support platform, said support platform including a tray;

b) a linear actuator connected between said base and said support platform and operable to move said support platform between a lowered position adjacent to said base and at least one raised position spaced above said base; and c) a resilient contact block receivable on said tray, said contact block engageable with support structure on an underside of a vehicle and part of a set of contact blocks, said blocks in said set of contact blocks having faces with interlocking features allowing multiple ones of said contact blocks to be interlockingly stacked within said tray.

17. The jack assembly as in claim 16 wherein said blocks in said set of contact blocks having varying thicknesses.

18. The jack assembly as in claim 16 wherein said tray has a length sufficient to allow said contact block to be repositionable in a longitudinal direction relative to said support platform along said length of said tray.

19. The jack assembly as in claim 16 wherein said support platform includes two of said trays longitudinally spaced from each other along a length of said support platform and at least two of said contact blocks receivable on said trays.

* * * * *